US009856431B2

(12) United States Patent
Factor et al.

(10) Patent No.: US 9,856,431 B2
(45) **Date of Patent: *Jan. 2, 2018**

(54) METHOD AND COMPOSITION FOR IMPROVING THE COMBUSTION OF AVIATION FUELS

(71) Applicant: Afton Chemical Corporation, Richmond, VA (US)

(72) Inventors: Stephen A. Factor, Richmond, VA (US); Zachary John McAfee, Richmond, VA (US); Joseph Anthony Calderone, III, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/083,964

(22) Filed: Mar. 29, 2016

(65) Prior Publication Data

US 2017/0198230 A1 Jul. 13, 2017

Related U.S. Application Data

(63) Continuation-in-part of application No. 14/994,199, filed on Jan. 13, 2016.

(51) Int. Cl.
*C10L 1/30* (2006.01)
*C10L 10/02* (2006.01)
(Continued)

(52) U.S. Cl.
CPC ..... *C10L 10/10* (2013.01); *C10L 1/26* (2013.01); *C10L 1/30* (2013.01); *C10L 10/02* (2013.01);
(Continued)

(58) Field of Classification Search
CPC combination set(s) only.
See application file for complete search history.

(56) References Cited

U.S. PATENT DOCUMENTS 2,479,902 A 8/1949 Calingaert
2,818,417 A * 12/1957 Brown ..... C07F 13/00 123/1 A
(Continued)

FOREIGN PATENT DOCUMENTS

AU 732980 C 3/2002
AU 2003252892 A1 11/2003
(Continued)

OTHER PUBLICATIONS

Thomas A. Ward, 3.4.1 Aviation Fuel, Aerospace Propulsion Systems, Jan. 1, 2010, pp. 202-213, XP055375556, 13 pages.
(Continued)

*Primary Examiner* — Ellen McAvoy
*Assistant Examiner* — Chantel Graham
(74) *Attorney, Agent, or Firm* — Honigman Miller Schwartz and Cohn LLP; Jeffrey A. Chelstrom; Jonathan P. O'Brien

(57) ABSTRACT

An aviation fuel is formulated with manganese-containing compounds. The composition may include relatively high amounts of manganese up to about 500 mg Mn/l. A manganese-containing additive may reduce the smoke created during the combustion of the aviation fuel. Additionally, the aviation fuel composition may include manganese to improve octane and include a phosphorus-containing scavenger to reduce manganese oxide engine deposits. Further, isooctane is added in order to, with the manganese-containing compound, improve the octane number of the fuel.

23 Claims, 7 Drawing Sheets

Idle Test – Zoom 0 – 40 Seconds

(51) Int. Cl.
*C10L 10/04* (2006.01)
*C10L 10/10* (2006.01)
*C10L 1/26* (2006.01)

(52) U.S. Cl.
CPC ..... *C10L 10/04* (2013.01); *C10L 1/2641* (2013.01); *C10L 1/305* (2013.01); *C10L 2200/0236* (2013.01); *C10L 2200/0268* (2013.01); *C10L 2270/04* (2013.01); *C10L 2290/24* (2013.01)

(56) References Cited

U.S. PATENT DOCUMENTS

| | | | |
|---|---|---|---|
| 3,038,791 | A | 6/1962 | Orloff |
| 3,052,528 | A | 9/1962 | Roddick et al. |
| 3,063,819 | A | 11/1962 | Watt |
| 3,088,814 | A | 5/1963 | Gorsich et al. |
| 3,127,351 | A | 3/1964 | Brown |
| 3,160,592 | A | 12/1964 | Brown |
| 3,442,361 | A | 5/1969 | Gluckstein |
| 3,558,292 | A | 1/1971 | Abowd |
| 3,615,293 | A | 10/1971 | Hnizda |
| 3,966,429 | A | 6/1976 | Sprague et al. |
| 4,005,993 | A | 2/1977 | Niebylski et al. |
| 4,390,345 | A | 6/1983 | Somorjai |
| 5,470,358 | A | 11/1995 | Gaughan |
| 5,851,241 | A | 12/1998 | Studzinski et al. |
| 6,652,608 | B1 | 11/2003 | Orr |
| 7,572,303 | B2 | 8/2009 | Orr |
| 8,016,897 | B2 | 9/2011 | Lowery |
| 2002/0005008 | A1 | 1/2002 | Studzinski |
| 2005/0044778 | A1 | 3/2005 | Orr |
| 2008/0000148 | A1 | 1/2008 | Cunningham |
| 2008/0005958 | A1 | 1/2008 | Factor |
| 2014/0128644 | A1 | 5/2014 | Braly |

FOREIGN PATENT DOCUMENTS

| | | | |
|---|---|---|---|
| AU | 2005201102 | B2 | 4/2005 |
| CA | 2310056 | A1 | 12/1999 |
| CA | 2256042 | C | 7/2006 |
| EP | 0609089 | A1 | 8/1994 |
| EP | 0910617 | B1 | 7/2003 |
| FR | 1162768 | | 9/1958 |
| GB | 872820 | A | 7/1961 |
| JP | 3660357 | B2 | 6/2005 |
| JP | 2005272850 | A | 10/2005 |
| WO | 9640844 | A1 | 12/1996 |
| WO | 9826028 | A1 | 6/1998 |
| WO | 2005087901 | A2 | 9/2005 |
| WO | 2012015506 | A1 | 2/2012 |
| WO | 2015197855 | A1 | 12/2015 |
| WO | 2016010966 | A1 | 1/2016 |

OTHER PUBLICATIONS

Partial European Search Report; European Application No. EP 17161582.6; dated Jun. 9, 2017; 15 pages.
European Search Report, European Application No. 17161575.0, dated Jul. 10, 2017, 8 pages.
Examination Report No. 1 for corresponding AU Application No. AU 2017201950 dated Sep. 11, 2017.
Examination Report No. 1 for corresponding AU Application No. AU 2017201887 dated Sep. 11, 2017.

* cited by examiner

Idle Test – Zoom 0 – 40 Seconds

Idle Test – Average Bins

FIGURE 4

| Fuel ID | Blend Description | Alkylate Vol% | Toluene Vol% | Isopentane Vol% | Isooctane Vol% | Heptane Vol% | MMT mg Mn/L | Sum of Vol% | MON | ΔMON Increase |
|---|---|---|---|---|---|---|---|---|---|---|
| 1 | 98:2 Isooctane:Heptane | 0 | 0 | 0 | 98 | 2 | 0 | 100 | 98.2 | N/a |
| 2 | Alkylate no MMT | 100 | 0 | 0 | 0 | 0 | 0 | 100 | 92.6 | N/a |
| 3 | Alkylate + MMT | 100 | 0 | 0 | 0 | 0 | 75 | 100 | 96.8 | 4.2 |
| 4 | Alkylate + MMT | 100 | 0 | 0 | 0 | 0 | 125 | 100 | 99.2 | 6.6 |
| 5 | Alkylate + MMT | 100 | 0 | 0 | 0 | 0 | 175 | 100 | 100.4 | 7.8 |
| 6 | Alkylate + MMT | 100 | 0 | 0 | 0 | 0 | 225 | 100 | 100.8 | 8.2 |
| 7 | Toluene no MMT | 0 | 100 | 0 | 0 | 0 | 0 | 100 | 108 | N/a |
| 8 | Toluene + MMT | 0 | 100 | 0 | 0 | 0 | 75 | 100 | 108 | 0 |
| 9 | Toluene + MMT | 0 | 100 | 0 | 0 | 0 | 125 | 100 | 109 | 1 |
| 10 | Toluene + MMT | 0 | 100 | 0 | 0 | 0 | 175 | 100 | 108 | 0 |
| 11 | Toluene + MMT | 0 | 100 | 0 | 0 | 0 | 225 | 100 | 108 | 0 |
| 12 | Isopentane no MMT | 0 | 0 | 100 | 0 | 0 | 0 | 100 | 87.7 | N/a |
| 13 | Isopentane + MMT | 0 | 0 | 100 | 0 | 0 | 75 | 100 | 93.3 | 5.6 |
| 14 | Isopentane + MMT | 0 | 0 | 100 | 0 | 0 | 125 | 100 | 95.1 | 7.4 |
| 15 | Isopentane + MMT | 0 | 0 | 100 | 0 | 0 | 175 | 100 | 96.7 | 9 |
| 16 | Isopentane + MMT | 0 | 0 | 100 | 0 | 0 | 225 | 100 | 95.9 | 8.2 |
| 17 | Isooctane no MMT | 0 | 0 | 0 | 100 | 0 | 0 | 100 | 99.7 | N/a |
| 18 | Isooctane + MMT | 0 | 0 | 0 | 100 | 0 | 75 | 100 | 102.6 | 2.9 |
| 19 | Isooctane + MMT | 0 | 0 | 0 | 100 | 0 | 125 | 100 | 104 | 4.3 |
| 20 | Isooctane + MMT | 0 | 0 | 0 | 100 | 0 | 175 | 100 | 105 | 5.3 |
| 21 | Isooctane + MMT | 0 | 0 | 0 | 100 | 0 | 225 | 100 | 106 | 6.3 |
| 22 | 98:2 Isooctane:Heptane | 0 | 0 | 0 | 98 | 2 | 0 | 100 | 98.2 | N/a |

FIGURE 5

Calculated MON for Alternative Aviation Fuel Formulations

| Description | Alkylate vol% | Toluene vol% | Isopentane vol% | Isooctane vol% | Tricresyl Phosphate mg P/L |
|---|---|---|---|---|---|
| Blend 1 | 70 | 30 | 0 | 0 | 33 |
| Blend 2 | 70 | 15 | 5 | 10 | 33 |
| Blend 3 | 50 | 15 | 5 | 30 | 33 |
| Blend 4 | 45 | 20 | 5 | 30 | 89 |
| Blend 5 | 40 | 10 | 10 | 40 | 89 |
| Blend 6 | 20 | 10 | 20 | 50 | 89 |
| Blend 7 | 50 | 15 | 5 | 30 | 33 |
| Blend 8 | 20 | 10 | 20 | 50 | 89 |
| Blend 9 | 70 | 30 | 0 | 0 | 33 |
| Blend 10 | 70 | 15 | 5 | 10 | 33 |
| Blend 11 | 50 | 15 | 5 | 30 | 33 |
| Blend 12 | 50 | 15 | 5 | 30 | 89 |
| Blend 13 | 25 | 20 | 5 | 50 | 89 |
| Blend 14 | 40 | 10 | 10 | 40 | 89 |
| Blend 15 | 20 | 10 | 20 | 50 | 89 |
| Blend 16 | 25 | 20 | 5 | 50 | 89 |
| Blend 17 | 20 | 10 | 20 | 50 | 89 |
| Blend 18 | 70 | 5 | 5 | 20 | 33 |
| Blend 19 | 70 | 15 | 5 | 10 | 33 |
| Blend 20 | 50 | 15 | 5 | 30 | 89 |
| Blend 21 | 35 | 10 | 15 | 40 | 89 |
| Blend 22 | 45 | 20 | 5 | 30 | 175 |
| Blend 23 | 40 | 10 | 10 | 40 | 175 |
| Blend 24 | 20 | 10 | 20 | 50 | 175 |
| Blend 25 | 70 | 15 | 5 | 10 | 33 |
| Blend 26 | 50 | 15 | 5 | 30 | 89 |
| Blend 27 | 35 | 10 | 15 | 40 | 89 |
| Blend 28 | 40 | 10 | 10 | 40 | 175 |
| Blend 29 | 20 | 10 | 20 | 50 | 175 |

Figure 5 (cont.)

| mmt® mg Mn/L | HiTEC® 4733 Antioxidant mg/L | Calculated MON | sum of vol% | P/Mn ratio | Calculated Energy Content Btu/lb |
|---|---|---|---|---|---|
| 75 | 12 | 94.5 | 100 | 0.78 | 18444 |
| 75 | 12 | 94.1 | 100 | 0.78 | 18768 |
| 75 | 12 | 96.2 | 100 | 0.78 | 18770 |
| 75 | 12 | 94.2 | 100 | 2.10 | 18660 |
| 75 | 12 | 94.6 | 100 | 2.10 | 18897 |
| 75 | 12 | 97.3 | 100 | 2.10 | 18923 |
| 75 | 0 | 96.2 | 100 | 0.78 | 18770 |
| 75 | 0 | 97.3 | 100 | 2.10 | 18923 |
| 125 | 12 | 96.3 | 100 | 0.47 | 18444 |
| 125 | 12 | 96.1 | 100 | 0.47 | 18768 |
| 125 | 12 | 98.2 | 100 | 0.47 | 18770 |
| 125 | 12 | 96.5 | 100 | 1.26 | 18770 |
| 125 | 12 | 99.2 | 100 | 1.26 | 18663 |
| 125 | 12 | 97.6 | 100 | 1.26 | 18897 |
| 125 | 12 | 100.3 | 100 | 1.26 | 18923 |
| 125 | 0 | 99.2 | 100 | 1.26 | 18663 |
| 125 | 0 | 100.3 | 100 | 1.26 | 18923 |
| 225 | 12 | 98.0 | 100 | 0.26 | 19000 |
| 225 | 12 | 100.2 | 100 | 0.26 | 18768 |
| 225 | 12 | 99.7 | 100 | 0.70 | 18770 |
| 225 | 12 | 101.7 | 100 | 0.70 | 18910 |
| 225 | 12 | 99.4 | 100 | 1.38 | 18660 |
| 225 | 12 | 100.1 | 100 | 1.38 | 18897 |
| 225 | 12 | 102.7 | 100 | 1.38 | 18923 |
| 225 | 0 | 100.2 | 100 | 0.26 | 18768 |
| 225 | 0 | 99.7 | 100 | 0.70 | 18770 |
| 225 | 0 | 101.7 | 100 | 0.70 | 18910 |
| 225 | 0 | 100.1 | 100 | 1.38 | 18897 |
| 225 | 0 | 102.7 | 100 | 1.38 | 18923 |

METHOD AND COMPOSITION FOR IMPROVING THE COMBUSTION OF AVIATION FUELS

This application is a continuation-in-part of U.S. patent application Ser. No. 14/994,199 filed on Jan. 13, 2016, incorporated herein by reference in its entirety.

This invention relates to substantially lead-free aviation fuel compositions. The invention is further directed to the use of these aviation fuels that also include a manganese-containing additive and optionally isooctane in order to increase the octane of the fuel, and a scavenger compound.

BACKGROUND

For at least regulatory reasons, aviation fuels are well into the process of becoming unleaded fuels. The removal of lead from a fuel, however, has the undesired effect of lowering the knock rating of a fuel. Accordingly, as aviation fuels are in the process of becoming unleaded, the formulation of those fuels must account for the octane reduction from losing lead. The addition of her fuel components is needed.

A common way to improve octane performance is to incorporate into an aviation fuel a high amount of aromatic hydrocarbons. These aromatic hydrocarbons allow the aviation fuel to be unleaded but still meet knock rating requirements. However, the use of significant amounts of aromatic hydrocarbons in the aviation fuel changes the burn efficiency of that fuel and results in increasing formation of smoke during the combustion process. Needless to say, increased amounts of smoke are undesirable in terms of aesthetics and environmental impact. Generally speaking, the higher the amount of aromatic hydrocarbons incorporated into a fuel composition, the higher the amount of smoke that is produced during combustion of that fuel.

Another strategy to improve octane performance is incorporate into an aviation fuel a manganese-containing additive. Manganese additives allow the aviation fuel to be unleaded but still improve the knock rating requirements over an unadditized and unleaded fuel composition.

SUMMARY

Accordingly, it is an object of the present invention to formulate an aviation fuel composition that includes both high aromatic content for octane purposes together with an effective amount of a manganese compound to reduce the smoke created during the combustion of the aviation fuel. Alternatively, the aviation fuel composition may include manganese to improve octane and a scavenger to reduce manganese oxide engine deposits. One such useful scavenger is tricresyl phosphate. Still further alternatively, the aviation fuel composition may include isooctane and/or isopentane to improve the octane number rating of the fuel.

In one example, a substantially unleaded aviation fuel composition comprises from 0 to about 80 volume percent of aviation alkylate. The fuel composition in this example comprises from about zero to 50 volume percent of isooctane and from about zero to 20 volume percent of isopentane. The fuel composition further comprises from about zero to 30 volume person of aromatic hydrocarbons. And the fuel composition comprises from about 0.5 to 500 mgMn/l of one or more cyclopentadienyl manganese tricarbonyl compounds, and a manganese scavenger compound. The composition is substantially lead-free, and the composition has a rating number of at least about 96 as determined by ASTM Test Method D 2700.

In another example, a method reducing the amount of smoke that results from the combustion of an aviation fuel comprises several steps. The method includes providing a spark-ignited aviation engine, and providing a substantially unleaded aviation fuel composition as described herein. The method next includes combusting the aviation fuel composition in the engine to create an exhaust plume, wherein the exhaust plume comprises less smoke as compared with a comparable aviation fuel composition that is otherwise identical but for the comparable aviation fuel composition does not comprise essentially any manganese.

BRIEF DESCRIPTION OF THE DRAWINGS

FIG. 4 is a table of comparative rating octane numbers for various additive components in combination with increasing amounts of manganese-containing compounds.

FIG. 5 is a table of calculated MON and energy content for various alternative aviation fuel formulations.

DETAILED DESCRIPTION

Figure 1:
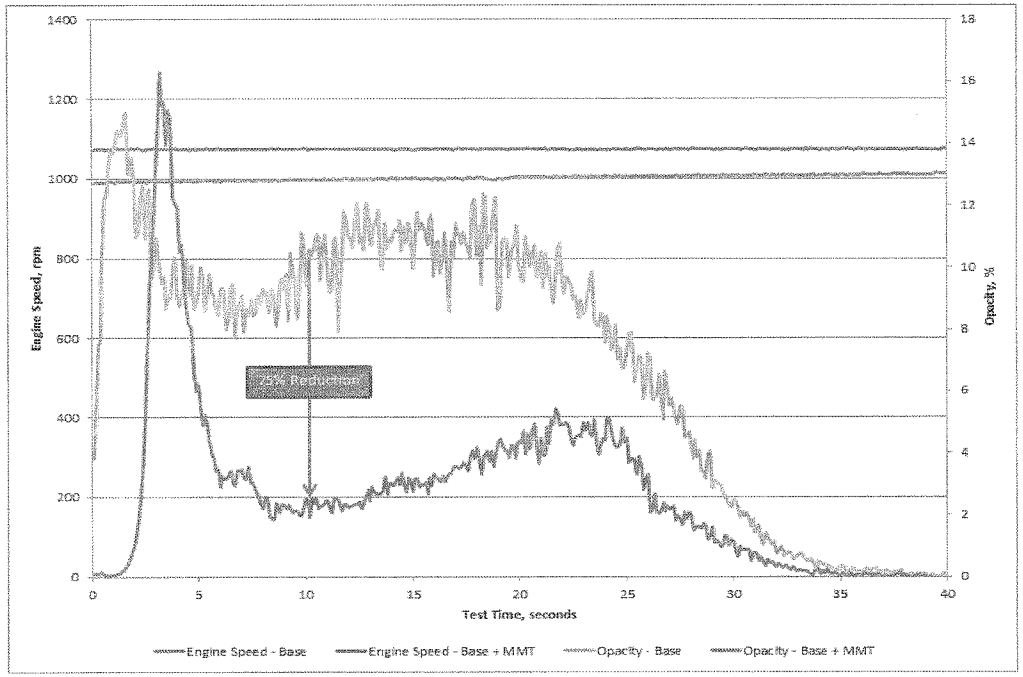
FIG. 1 is a graph displaying comparative emission opacity performance.

The aviation fuel described herein is a lead-free fuel composition that may or may not include a significant aromatic content. As an aviation fuel, the fuel may include aviation alkylates. Specifically, the fuel composition as described herein shall additionally have an aromatic hydrocarbon content of about zero to 30 percent by volume. In order to offset the smoke created during the combustion of an aromatic-containing fuel, 0.5 to 500 mg Mn/l is incorporated in the fuel composition. The resulting fuel has a minimum knock value lean rating octane number of at least about 96 or alternatively at least about 98, or further alternatively at least about 99.5 as determined by ASTM Test Method D 2700. Even fuels with a more conventional ratio of aviation alkylates and aromatic hydrocarbons benefit from the addition of manganese as described to improve the fuel octane number.

Also described herein is a method of reducing the amount of smoke that results from the combustion of a lead-free aviation fuel. An aviation fuel that may include aviation alkylates and about 20 to 90 percent of aromatic hydrocarbons creates an increase in visible smoke and particulate during combustion. By adding about 0.5 to 500 mg Mn/l of one or more cyclopentadienyl manganese tricarbonyl components, the amount of smoke that is created in the exhaust plume is reduced as compared with the same aviation fuel composition that is otherwise identical except that it does not comprise essentially any manganese.

Even in an aviation fuel that may include a conventional aviation fuel composition of aviation alkylates, aromatic hydrocarbons and isopentane, and in another example, by adding about 0.5 to 500 mg Mn/l of one or more cyclopentadienyl manganese tricarbonyl compounds, the octane of the fuel composition is improved to at least an octane number of about 96, or about 98, or alternatively about 99.5. An additive package that includes manganese at the amount of 0.5 to 500 mg Mn/l, or alternatively about 1 to 250 mg Mn/l, or still further alternatively about 125 to 225 mg Mn/l may also include antioxidant and one or more scavenger components. The scavenger component may in one example be tricresyl phosphate (TCP), phosphorus-containing organic oligomers, or DMMP (dimethyl methyl phosphonate). The TCP may be added in an effective amount to scavenge the manganese combustion products. Without being limited to this explanation, it is believed that a compound formed from the combustion of a manganese compound (e.g. MMT) and a phosphorus compound (e.g. TCP) could be a number of manganese phosphate species. In one embodiment, TCP is used in a treat rate that is about equally stoichiometric with the manganese to phosphate ratio. Alternatively, the TCP may be added in the range of about 1:0.1 up to 1:10 manganese to phosphorus, or still further alternatively about 1:0.5 to 1:3.

When using a manganese compound as an additive in an aviation fuel composition, there can be the formation of a manganese oxide deposit. The formulation that includes the scavengers described herein can substantially reduce the occurrence of any manganese oxide engine deposits.

It has been discovered that the benefits of the scavenger in reducing or modifying manganese-containing deposits may however have a negative effect with respect to the octane rating number of the aviation fuel composition. Additionally, the use of a manganese-containing additive component may have practical limits with respect to improvements in an octane rating number. Accordingly, it is found that the inclusion of isooctane in a fuel composition, especially in combination with a manganese-containing component, and especially a cyclopentadienyl manganese tricarbonyl component, can improve the octane rating number of the fuel composition substantially. Specifically, the isooctane can offset the otherwise negative octane effect of a manganese scavenger.

The inclusion of isooctane is counterintuitive in the context of aviation fuel compositions. Traditionally, aviation base fuels are refined to remove isooctane. This isooctane was then a distillation fraction that was sold separately. It has never before been considered in the formulation or additive package of an aviation fuel composition.

The amount of isooctane in a final fuel composition may vary depending on the attributes of a specific base fuel. The amount of isooctane may also vary with the amount of manganese-containing additive that is used. The isooctane is expected to be about zero to 50 volume percent of the fuel composition, or alternatively about 5 to 25 volume percent, or further alternatively about 10 to 20 volume percent. When incorporated. In an additive formulation, there must be a relative amount of isooctane adequate to obtain the final fuel composition content concentrations required. This will depend on the base fuel rating number octane and the amount of other additive components used.

Isooctane is also added to an aviation fuel composition with an isopentane fraction. Some amount of isopentane, for instance, about zero to 20 volume percent, or alternatively about 5 to 10 volume percent, is required to meet additional aviation fuel composition physical distillation requirements.

For the purposes of this application, a fuel composition is described in ASTM 4814 as substantially "lead-free" or "unleaded" if it contains 13 mg of lead or less per liter (or about 50 mg Pb/gal or less) of lead in the fuel. Alternatively, the terms "lead-free" or "unleaded" mean about 7 mg of lead or less per liter of fuel. Still further alternatively, it means an essentially undetectable amount of lead in the fuel composition. In other words, there can be trace amounts of lead in a fuel; however, the fuel is essentially free of any detectable amount of lead. It is to be understood that the fuels are unleaded in the sense that a lead-containing antiknock agent is not deliberately added to the gasoline. Trace amounts of lead due to contamination of equipment or like circumstances are permissible and are not to be deemed excluded from the fuels described herein.

The aviation fuel composition as described herein typically contains aviation alkylate components. Those components may comprise about 10 to 80 volume percent of the fuel. Aromatic hydrocarbons may be incorporated into the fuel to improve the octane rating of the fuel. These aromatic hydrocarbons are incorporated according to one example of the present invention at a rate of about zero to 30 volume percent of fuel composition. In another example, the aromatic hydrocarbons are incorporated at a rate of about 10 to 20 volume percent of the fuel composition.

The fuel blend may contain aromatic gasoline hydrocarbons, at least a major proportion of which are mononuclear aromatic hydrocarbons such as toluene, xylenes, the mesitylenes, ethyl benzene, etc. Other suitable optional gasoline hydrocarbon components that can be used in formulating the aviation fuels described herein include isopentane light hydrocracked gasoline fractions, and/or $C_{5-6}$ gasoline isomerate.

Cyclopentadienyl manganese tricarbonyl compounds which car be used in the practice of the fuels herein include cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tertbutylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. Preferred are the cyclopentadienyl manganese tricarbonyls which are liquid at room temperature such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of nrethylcyclopentadienyl manganese tricarbonyl and ethylcyclopentadienyl manganese tricarbonyl, etc. The aviation fuels of this invention will contain an amount of one or more of the foregoing cyclopentadienyl manganese tricarbonyl compounds sufficient to provide the requisite octane number and valve seat wear performance characteristics.

Other components which can be employed, and under certain circumstances are preferably employed, include dyes which do not contribute to excessive induction system deposits. Typical dyes which can be employed are 1,4-dialkylaminoanthraquinone, p-diethylaminoazobenzene (Color Index No. 11020) or Color Index Solvent Yellow No. 107, methyl derivatives of azobenzene-4-azo-2-naphthol (methyl derivatives of Color Index No. 26105), alkyl derivatives of azobenzene-4-azo-2-naphthol, or equivalent materials. The amounts used should, wherever possible, conform to the limits specified in ASTM Specification D 910-90.

Antioxidants such as 2,6-di-tert-butylphenyl, 2,6-di-Cert-butyl-p-cresol, phenylenediamines such as N,N'-di-sec-butyl-p-phenylenediamine, N-isopropylphenylenediamine, and the like, may be present. Depending on different base fuels and performance requirements, of course other anti-oxidants may be used.

Fuel system icing inhibitors may also be included in the fuels herein. Preferred are ethylene glycol monomethyl ether and isopropyl alcohol, although materials giving equivalent performance may be considered acceptable for use. Amounts used should, wherever possible, conform to the limits referred to in ASTM Specification D 910-90.

The manganese scavenger compound may be any compound that interacts with the manganese-containing additive component. By "scavenging" herein is meant the contacting, combining with, reacting, incorporating, chemically bonding with or to, physically bonding with or to, adhering to, agglomerating with, affixing, inactivating, rendering, inert, consuming, alloying, gathering, cleansing, consuming, modifying, converting, or any other way or means whereby a first material makes a second material unavailable or less available. Examples of manganese scavengers include phosphorus-containing compounds, organobromides, and tricarbonyls. As explained earlier, these scavengers may have varying effects on the rating number octane of the fuel containing the manganese compound. The amount of isooctane to boost the rating octane number may vary accordingly.

In the example of a phosphorus-containing scavenger, the scavenger may be added in the amount to be a stoichiometric ratio to Mn to P of from about 1:0.1 to 110, or alternatively, about 1:0.5 to 1:3.

Example 1

In order to demonstrate an exemplary aviation fuel and the corresponding reduction in smoke formation from combustion of that fuel, a spark ignition engine is used. The spark ignition engine is actually an automotive engine for a 1994 Chevrolet Silverado. This automobile engine was unable to run on pure aviation fuel, so a mixture of 50% EEE automotive gasoline and 50% aviation fuel was used. The aviation fuel blend base line was 83% mesitylene and 17% isopentane. An idle test was run and the opacity of the emissions was measured. In the test, as shown in FIG. 1, the opacity leveled off to approximately zero at shortly before 40 seconds of operation for both the control fuel composition (no Mn added) and the control fuel mixed with a manganese compound. The opacity of the control base fuel was much higher than the opacity of the base fuel mixed with a manganese component, including a reduction in opacity of up to at least about 75% as shown. The reduction in opacity may alternatively be about 10%-60%, or still further alternatively about 25%-50%, as also shown. Specifically, the manganese component that was mixed in was HiTEC® 3000, which results in a manganese mg Mn/l treatment of 18 milligrams manganese per liter of fuel. It is noted that the smoke production is highly dependent on air/fuel ratio. Furthermore, the particular emissions control unit for the test engine is able to adapt the air/fuel ratio within about 35 seconds to remove the smoke formation caused from the combustion of the fuel.

Figure 2:
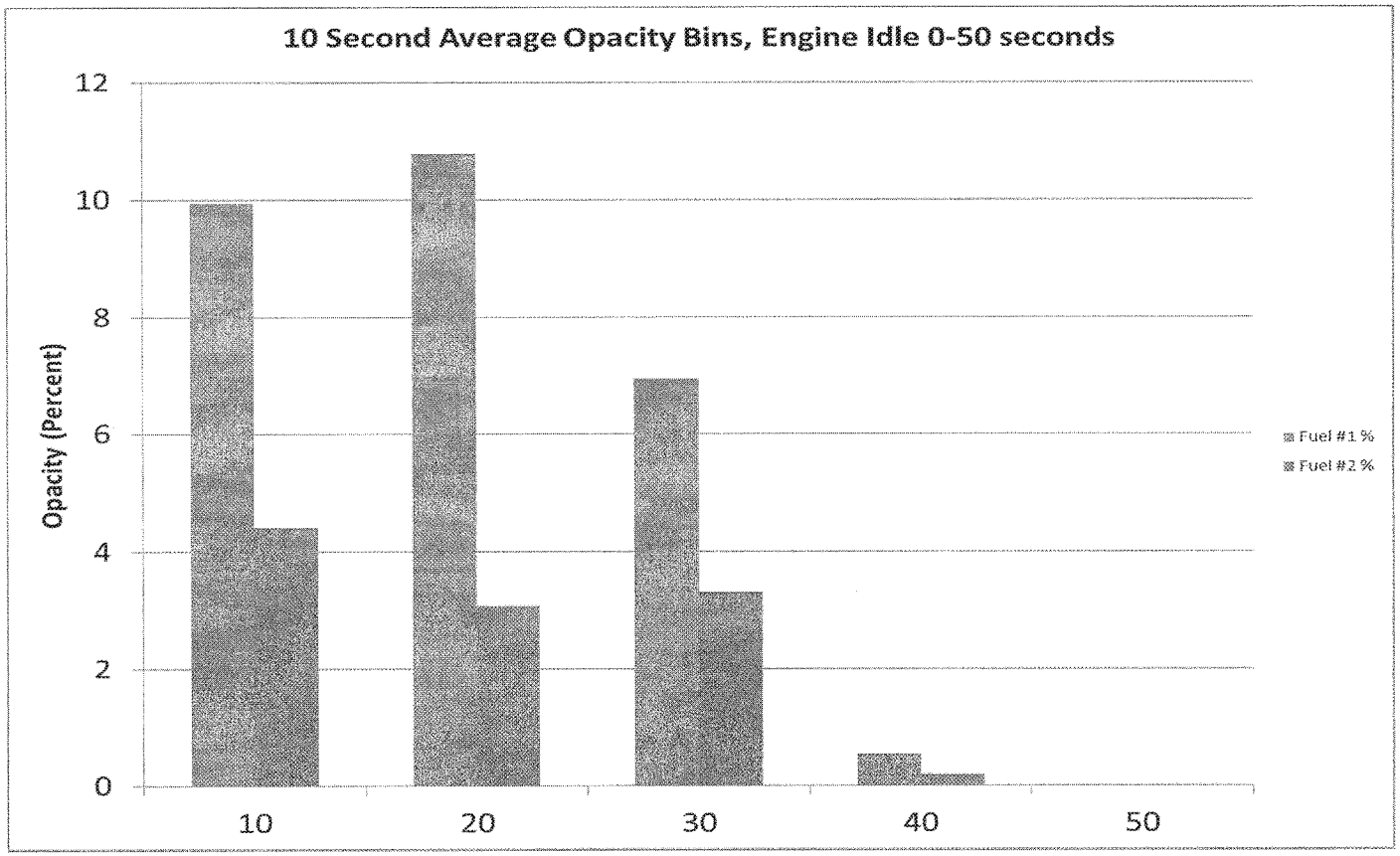
FIG. 2 is a bar graph that illustrates average emission opacity for each of the ten second periods through the first 40 seconds of combustion.

Finally, referring to FIG. 2, the average opacity for each of the 10 second periods through the first 40 seconds of combustion demonstrates, in each case, the opacity of the untreated fuel is significantly greater than the opacity of the fuel that includes the manganese additive.

Example 2

In another example, an unleaded aviation fuel was additized with an additive package to improve the octane number of the fuel. The base, unleaded aviation fuel was comprised of aviation alkylates 72%, aromatic hydrocarbons 20%, isopentane 8%, a motor octane number, MON (ASTM D2700 Method) of 93. An additive package comprising a treat rate of 125 mg Mn/l and 2.12 g/gal of tricresylphosphate (TCP) was added to the base fuel to increase the octane number to 96.

It was discovered that the resulting amounts of combustion engine deposits containing manganese oxides were greatly reduced due to the phosphorus compound addition. Testing was performed on a Honda Accord on a chassis dynamometer. The vehicles On Board Diagnostics (OBD) system was used to monitor spark plug misfire. The vehicle was run on comparative fuel formulations until the OBD system indicated a cylinder misfire. Candidate formulations containing MMT and the TCP scavenger had significantly longer time to misfire than candidate formulations containing MMT alone.

Figure 3:
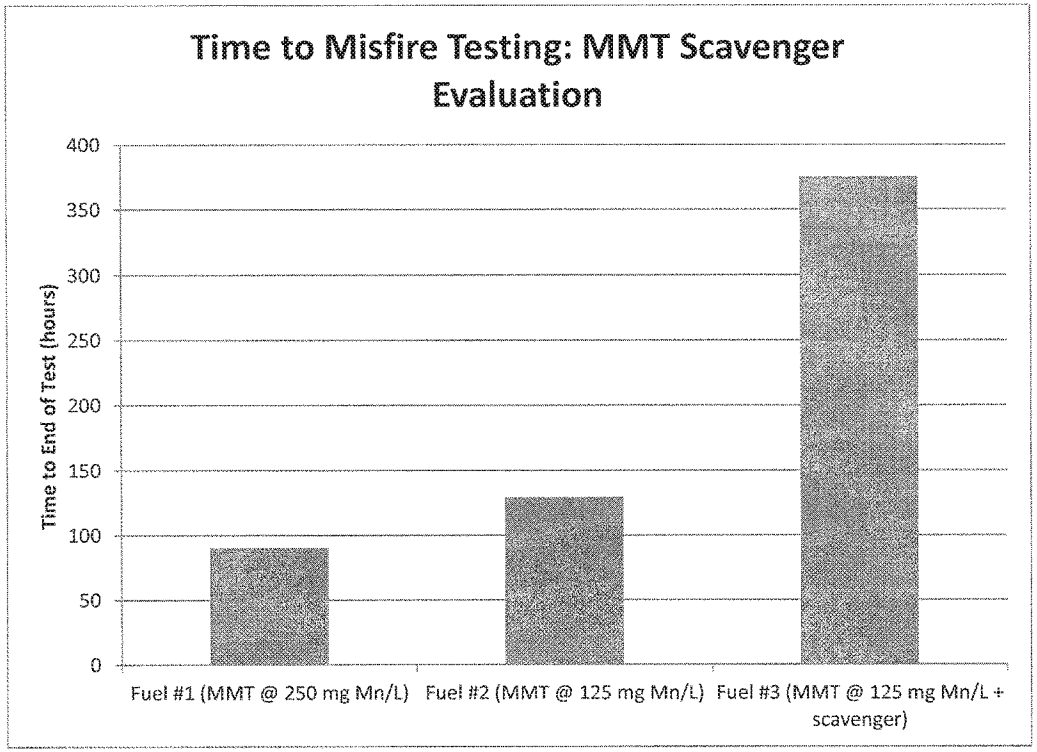
FIG. 3 is a bar graph illustrating comparative time before misfire testing.

As shown in FIG. 3, fuels #1 and #2 were run on test vehicles and included 250 and 125 mg Mn/l respectfully, Fuel #3 included both 125 mg Mn/l and a scavenger and the improved performance is readily visible on the chart of FIG. 3.

Thus, Example 2 illustrates a method of delaying or eliminating spark plug misfire caused by accumulation of manganese oxide engine deposits that result from the combustion of an aviation fuel composition comprising manganese, the method comprising the steps of:

providing a spark-ignited aviation engine;

providing a substantially unleaded aviation fuel composition comprising:

(a) from about 10 to about 80 volume percent of aviation alkylate;

(b) from about 20 to about 90 volume percent of aromatic hydrocarbons;

(c) from about 0.5 to 500 mg Mn/l of one or more cyclopentadienyl manganese tricarbonyl; and (d) an effective amount of phosphorus compound such as tricresyl phosphate;

wherein the composition is substantially lead-free, and the composition has a minimum knock value lean rating octane number of at least about 96 as determined by ASTM Test Method D2700;

combusting the aviation fuel composition in the engine to create engine deposits;

wherein the engine deposits are comprised of less manganese oxide as compared with deposits produced from the combustion of a comparable aviation fuel composition that is otherwise identical but for the comparable aviation fuel composition does not comprise essentially any phosphorus-containing material such as tricresyl phosphate.

Example 3

A panel of tests was run to determine the effect on MON (motor octane number) with increasing amounts of manganese-containing additive, in these examples methylcyclopentadienyl manganese tricarbonyl (MMT®). FIG. 4 sets forth the results of the testing.

Referring to those results alkylate, which does contain some percentage isooctane that depends on the alkylation unit's conditions, has a strong response to mmt. But, lower starting octane components respond strongly to mint.

Toluene, although a high octane component, does not respond to mint at any treat rate. This is typical for aromatic components.

Isopentane (which is added to the formula to meet a distillation specification) responds strongly to mmt. But, isopentane has a lower starting MON, so it will respond strongly to mmt.

Isooctane does not respond as strongly to mmt as alkylate or isopentane but has the highest MON at 225 mg Mn/l when compared to alkylate or isopentane. Therefore, isooctane is used because it is a high inherent octane component that additionally responds strongly to mmt (compared to toluene).

Example 4

Based on actual experimental results and panels of tests, including but not limited to the results in FIG. 4, and on extrapolations and calculations, calculations for both MON and energy content (Btu/lb) are shown in FIG. 5 for comparative aviation fuel compositions. As shown, the fuels contain varying amounts of aviation alkylate, aromatic hydrocarbons (using toluene as an example), isopentane, isooctane, a phosphorus-containing scavenger (using tricresyl phosphate as an example), manganese-containing compound (using Mmt®, including methylcyclopentadienyl manganese tricarbonyl as an example), and an optional antioxidant.

Figure 6:
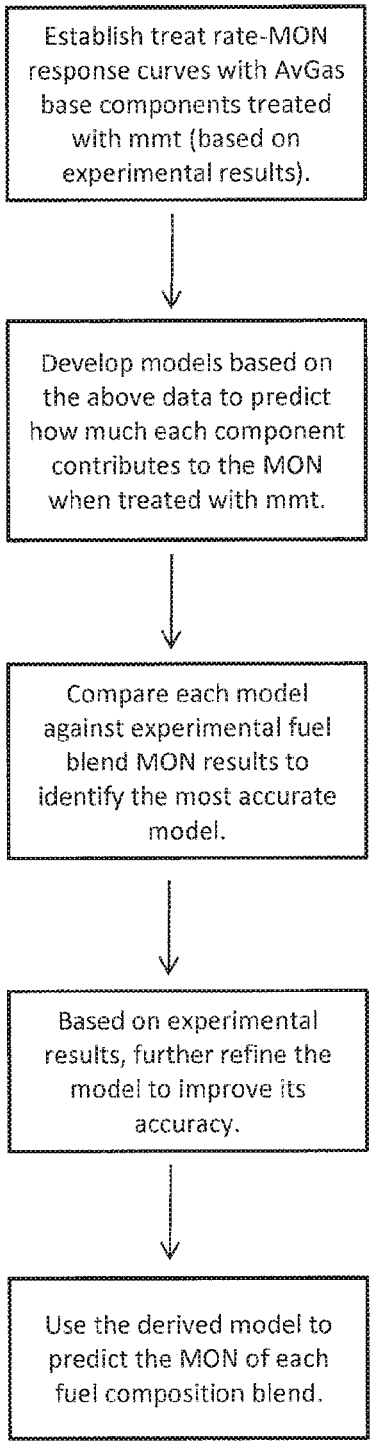
FIG. 6 is a flowchart of the calculation that led to the calculated MON and energy content values in FIG. 5.

Different but similar calculations may be used to obtain a calculated MON and energy content. Relatively more actual experimental results or more derived models may be used. FIG. 6 is a flow chart of calculations used to reach the calculated results of MON in FIG. 5. A similar calculation may be used for the energy content that is also shown in FIG. 5. A combination of actual test results and a derived model is used together with ASTM D3338 to estimate the net heat combustion of aviation fuels.

Other embodiments of the present disclosure will be apparent to those skilled in the art from consideration of the specification and practice of the disclosure disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the disclosure being indicated by the following claims.

That which is claimed is:

1. An aviation fuel composition comprising:

(a) from about 10 to about 80 volume percent of aviation alkylate;

(b) from about 5 to 50 volume percent isooctane;

(c) from about 5 to 20 volume percent of isopentane;

(d) from about zero to about 30 volume percent of aromatic hydrocarbons;

(e) from about 0.5 to 500 mg Mn/l of one or more cyclopentadienyl manganese tricarbonyl; and (f) a manganese scavenger compound, wherein the manganese scavenger compound comprises an aviation fuel soluble phosphorus-containing compound;

wherein the composition is substantially lead-free, and the composition has a rating number of at least about 96 as determined by ASTM Test Method D 2700.

2. An aviation fuel composition as described in claim 1, comprising about 15 to 20 volume percent of aromatic hydrocarbons.

3. An aviation fuel composition as described in claim 1, comprising about 5 to 10 volume percent of isopentane.

4. An aviation fuel composition as described in claim 1, wherein the aviation fuel includes 13 mg of lead or less per liter of fuel composition.

5. An aviation fuel composition as described in claim 1, wherein the aviation fuel includes about 7 mg of lead or less per liter of fuel composition.

6. An aviation fuel composition as described in claim 1, wherein the aviation fuel includes an essentially undetectable amount of lead in the fuel composition.

7. An aviation fuel composition as described in claim 1, wherein the cyclopentadienyl manganese tricarbonyl is selected from the group consisting of cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tertbutylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds.

8. An aviation fuel composition as described in claim 1, wherein the cyclopentadienyl manganese tricarbonyl comprises methylcyclopentadienyl manganese tricarbonyl.

9. An aviation fuel composition as described in claim 1, wherein the fuel composition comprises about one to 250 mg Mn/l.

10. An aviation fuel composition as described in claim 1, wherein the fuel composition comprises about 125 to 225 mg Mn/l.

11. An aviation fuel composition as described in claim 1, wherein the composition has a rating number of at least about 100 as determined by ASTM Test Method D 2700.

12. An aviation fuel composition as described in claim 1, wherein the aromatic hydrocarbons are selected from the group consisting of toluene, xylenes, and mesitylenes.

13. An aviation fuel composition as described in claim 1, wherein the phosphorus-containing compound comprises tricresyl phosphate.

14. An aviation fuel composition as described in claim 1, wherein the phosphorus-containing compound is present in an amount to be a stoichiometric ratio of Mn to P of from about 1:0.1 to 1:10.

15. An aviation fuel composition as described in claim 1, wherein the phosphorus-containing compound is present in an amount to be a stoichiometric ratio of Mn to P of from about 1:0.5 to 1:3.

16. An aviation fuel additive composition comprising:

(a) about 5 to about 50 volume percent isooctane and about 5 to about 20 volume percent isopentane;

(b) one or more cyclopentadienyl manganese tricarbonyl; and (c) a manganese scavenger compound, wherein the manganese scavenger compound comprises a phosphorus-containing compound;

wherein the additive is substantially lead-free.

17. An aviation fuel additive composition as described in claim 16, wherein the cyclopentadienyl manganese tricarbonyl is selected from the group consisting of cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tertbutylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds.

18. An aviation fuel additive composition as described in claim 16, wherein the cyclopentadienyl manganese tricarbonyl comprises methylcyclopentadienyl manganese tricarbonyl.

19. An aviation fuel additive composition as described in claim 16, wherein the manganese scavenger compound comprises tricresyl phosphate.

20. An aviation fuel additive composition as described in claim 16, wherein the manganese scavenger compound comprises a plurality of phosphorus-containing compounds.

21. An aviation fuel additive composition as described in claim 20, wherein the phosphorus-containing compounds include tricresyl phosphate.

22. A method of increasing the octane rating number of an aviation fuel comprising the steps of:

providing a fuel additive composition comprising about 5 to about 50 volume percent isooctane, about 5 to about 20 percent isopentane, a cyclopentadienyl manganese tricarbonyl compound, and a manganese scavenger, wherein the manganese scavenger comprises a phosphorus-containing compound;

adding the fuel additive composition to an aviation base fuel composition, wherein the resulting fuel composition has a rating number of at least about 98 as determined by ASTM Test Method D 2700.

23. A method of increasing the octane rating number of an aviation fuel as described in claim 22, wherein the resulting fuel composition has a rating number of at least about 100 as determined by ASTM Test Method D 2700.

* * * * *